US006725802B1

(12) United States Patent
Carrington et al.

(10) Patent No.: US 6,725,802 B1
(45) Date of Patent: Apr. 27, 2004

(54) INK PAD DISPENSER

(76) Inventors: John H. Carrington, 2316 Wakefield Plantation Rd., Raleigh, NC (US) 27614; David W. Harvey, 1450 Long Mill Rd., Youngsville, NC (US) 27596

( * ) Notice: Subject to any disclaimer, the term of this patent is extended or adjusted under 35 U.S.C. 154(b) by 0 days.

(21) Appl. No.: 10/423,175

(22) Filed: Apr. 28, 2003

(51) Int. Cl.[7] ..... B41K 1/54
(52) U.S. Cl. ..... 118/31.5; 118/264; 427/1
(58) Field of Search ..... 118/31.5, 264; 427/1; 101/125, 333

(56) References Cited

U.S. PATENT DOCUMENTS 3,830,195 A * 8/1974 Burleson ..... 118/31.5

* cited by examiner

*Primary Examiner*—Laura Edwards
(74) *Attorney, Agent, or Firm*—Mills Law Firm PLLC

(57) ABSTRACT

An ink dispenser includes a lower case having a cavity whereat a ceramic imprint ink dispensing plate is releasably retained by flexible tabs and including provisions for mechanically, frictionally and magnetically mounting the case on a variety of mounting surfaces.

8 Claims, 4 Drawing Sheets

INK PAD DISPENSER

FIELD OF THE INVENTION

The present invention relates to imprinting apparatus, and, in particular, to a ceramic ink pad dispenser providing improved assembly, mounting and imprinting.

BACKGROUND OF THE INVENTION

Stamp pad ink dispensers are employed for a variety of purposes wherein an object is pressed against an ink carry or dispensing surface and thereafter registered with an ink receiving surface. The situations requiring the procedure may vary from fixed locations to mobile and transient sites. Accordingly, a variety of dispensers have been developed for addressing the multiplicity of conditions.

Porous plate dispensers are now available wherein a finely pored substrate draws ink by capillary action upwardly from a foam dispenser pad to the imprinting surface. The imprinting plates are typically finely pored ceramics.

The ceramic plates and foam pads of the above type are generally serially assembled to the base of the dispenser case and each other with double sided adhesive tape. Considerable time and skills are required to ensure intimate contact at the interfaces to avoid gaps or wrinkles that would impair uniform ink transfer. Moreover, under ordinary usage and handling, the ceramic plates may separate from the underlying ink reservoir pad thereby also lessening the uniformity of the ink on the imprinting surface. Inasmuch as the separation is not readily repairable, the unit must be replaced in its entirety.

For field use, pocket carried cases are commonly used. For desk or other permanent locations, brackets are used to fixedly mount the applicator pad and case. For mobile applications, smaller cases and pads are preferred. The resultant variety of dispensers, sizes and mounting techniques result in a multitude of designs, even within a single organization and often at a compromise to the underlying task, i.e. reliably contemporaneously providing ink transfer for transfer in a quality format.

BRIEF SUMMARY OF THE INVENTION

The present invention provides a ceramic ink pad dispenser having a ceramic plate and compressible ink reservoir that may be readily assembled in a case and releasably compressively retained by flexible detent tabs. In addition to facilitating assembly, the tabs permit removal of the plate and pad for replacement as required. The dispenser base is provided with plural modes for operatively deposing the dispenser at common permanent and transient sites. First, the base includes fastener holes for allowing fixed attachment of the case at a permanent site. The lower surface of the base provides located attachments of magnetic strips and slip resistant pads allowing the case to be used on a variety of transiently available surfaces. All mounting modes are within the confines of a typical pocket envelope, providing convenient carrying to remote and mobile sites, thereby allowing a single design to be utilized for the preponderance of investigative occurrences.

Accordingly, it is an object of the invention to provide an imprint ink dispenser having a readily assembled and replaceable porous imprinting substrate.

Another object of the invention is to provide a ceramic ink dispensing pad that is uniformly compressively interfaced with a reservoir pad to provide uniform transfer of ink to the imprinting surface.

Another object of the invention is to provide an imprint case that may be deployed in a plurality of mounting modes.

Another object of the invention is to provide an imprinting pad and case that permits permanent and releasable mounting.

A further object is to provide a single format imprinting pad and case that may be mechanically, magnetically, adhesively or frictionally mounted on a working surface for securing imprints.

DESCRIPTION OF THE INVENTION

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
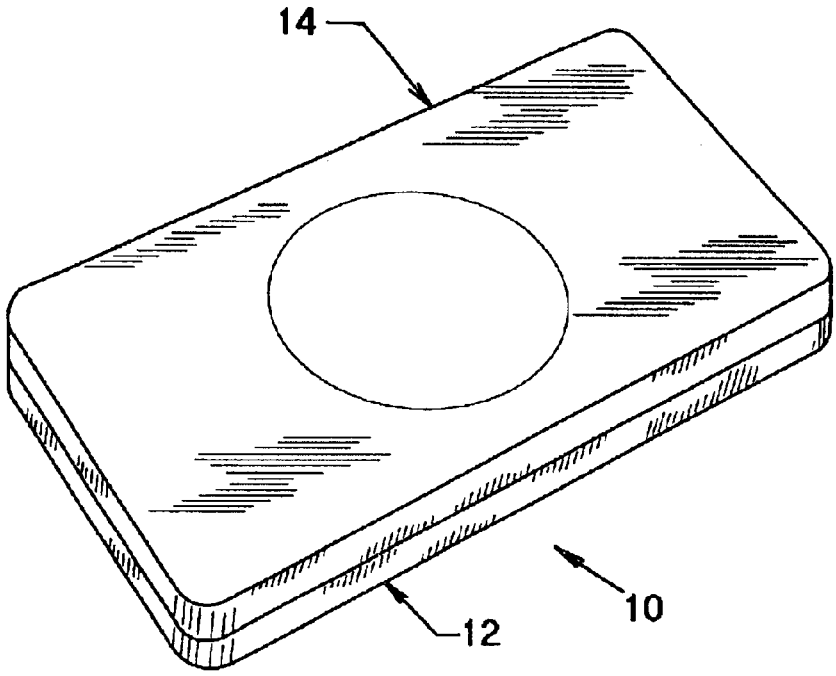
FIG. 1 is a top perspective view of a multiple mount ink pad dispenser in accordance with a preferred embodiment of the invention.

Referring to the drawings for the purpose of describing the preferred embodiment and not for limiting same, FIGS. 1 through 4 illustrate a ceramic imprint pad ink dispenser 10 comprising a base 12 and a removable lid 14.

Figure 4:
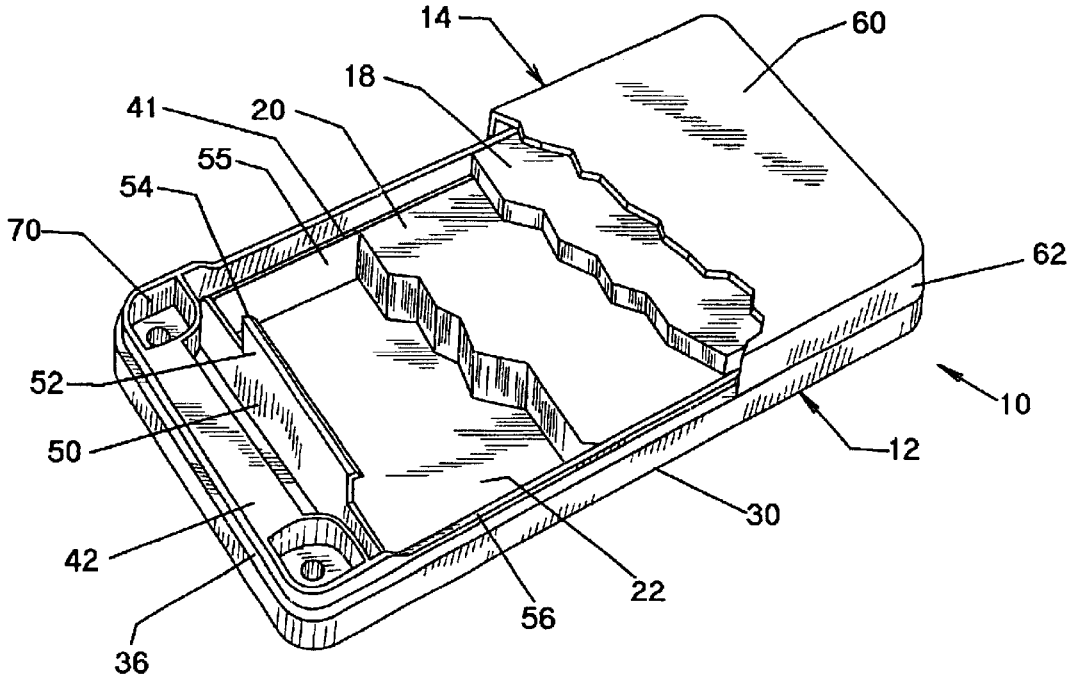
FIG. 4 is a partially sectioned top perspective view of the dispenser illustrating the interior print pad and ink dispenser.
Figure 5:
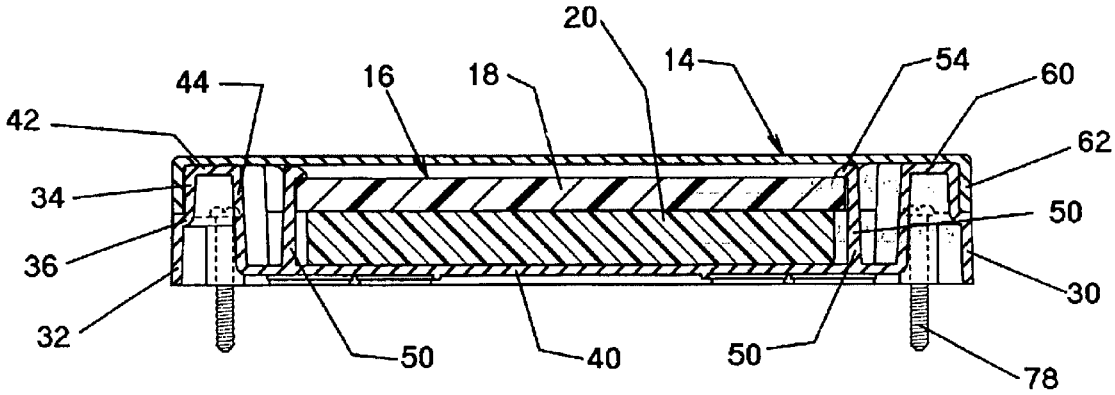
FIG. 5 is a center cross sectional view of the dispenser.

As shown in FIGS. 4 and 5, the base 12 carries a ceramic dispenser pad assembly 16 including a ceramic dispenser pad 18 releasably compressively overlying a foam ink reservoir pad 20 housed in a center upwardly opening dispenser cavity 22 formed in the base 12.

The base 12 is a one-piece plastic molding, preferably formed of a copolymer polypropylene. The base 12 includes a peripheral outer rim 30 having an outer surface including a lower leg 32 and an upper arm 34 located inwardly of the leg 32 and integrally interconnected therewith at a peripheral horizontal ledge 36. The inner surfaces of the outer rim 30 are connected at the lower end with a horizontal, generally rectangular base plate 40, with such inner surfaces and the top surface of the base plate 40 establishing the cavity 22. The longitudinal inner surfaces of the rim 30 are provided with inwardly projecting, longitudinally extending stop ledges 41.

Figure 6A:
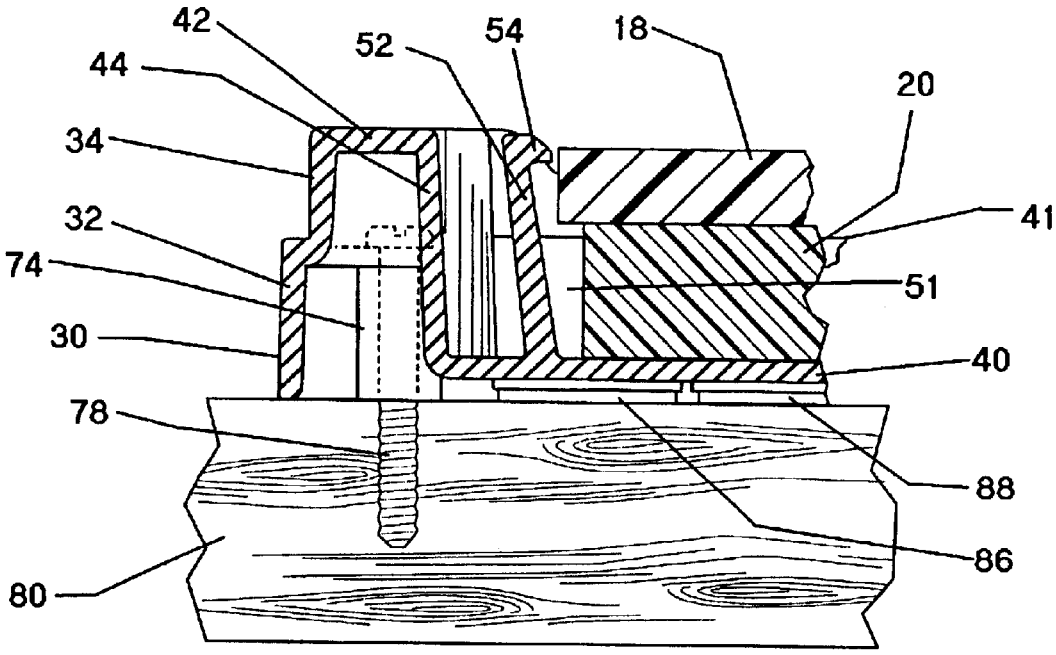
FIG. 6A is an enlarged fragmentary cross sectional view illustrating the deflection of the retaining: tabs prior to insertion pad assembly in the base.
Figure 6B:
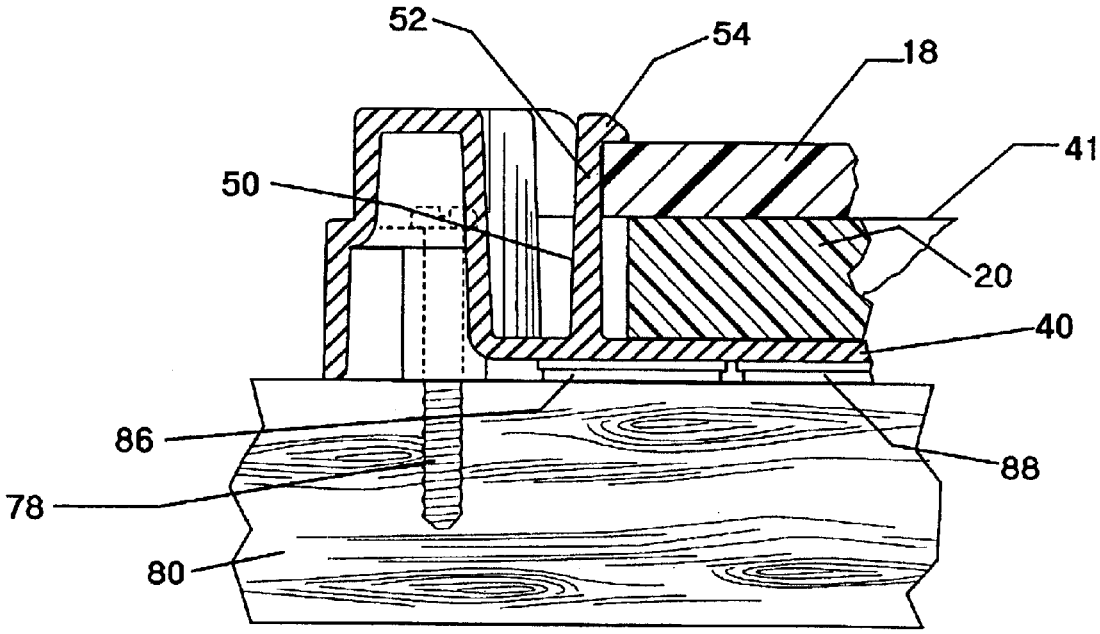
FIG. 6B is an enlarged fragmentary cross section view of the assembled dispenser.

The outer rim 30 includes inwardly extending transverse shoulders 42 at the lateral inner surfaces that inwardly terminate with a downwardly extending inner wall 44 merging with the base plate 40. A pair of laterally spaced vertical dividing walls 50 extend upwardly from the base plate 40 and transversely between the longitudinal inner surfaces of the rim 30. Each dividing wall 50 includes an upper deflectable mounting tab 52. Each mounting tab 52 upwardly terminates with an inwardly projecting, transversely extending retaining lip 54, generally triangular in cross section. The inner surfaces of the dividing walls 50 and the inner surfaces of the rim 30 establish an upwardly opening ink reservoir 51 having length substantially the same as the dispenser pad assembly 16 and a width slightly smaller than the dispenser pad 16. As shown in FIGS. 6A and 6B, the vertical distance between the base plate 40 and the retaining lip 54 is less than the free height thickness of the dispenser pad assembly 16 whereby in assembly condition the pad assembly is compressively retained thereby establishing continuous intimate contact between the interfacing surfaces of the pad 18 and pad 20. The height of the ledge 41 above the base plate 40 is slightly less than the uncompressed thickness of the reservoir pad 20, whereby in assembly the dispenser pad engages the stop ledges 41 to relatively fixedly retain the dispenser pad and avoid movement thereof during imprinting while ensuring sufficient compression of the reservoir pad to maintain continuous interfacial contact.

Referring to FIGS. 6A and 6B, for assembly, the reservoir pad 20 is placed freely on the bottom plate 40 within the reservoir, and preferably impregnated with a suitable conventional imprinting ink. Then the dispenser pad 18 is centered over the deflectable tabs 52 and pressed downwardly thereby resiliently outwardly deflecting the tabs 52. After the pad 18 passes downwardly over,the lips 54 and the lower surface engage the stop ledges 41, the tabs 52 resiliently return to the normal position with the lower surfaces of the lips 54 engaging the lateral edges of the top surface of the dispenser pad to lock compressive the pad assembly in assembled condition. Thus the dispenser pad 16 lightly compresses the reservoir pad 18 to establish intimate contact therewith and ensure a uniform absorption of the ink within the dispenser pad 16 thereby providing uniform ink transfer during imprint usage.

The foregoing retention of the dispenser pad assembly uses only a small portion of the dispenser working surface and does not restrict or interfere with imprinting operations. Additionally, the outer rim includes scalloped central longitudinal recessed wall sections 56 (FIGS. 3 and 4) thereby locating the upper imprinting surface thereabove thus providing additional freedom of movement in obtaining prints.

If the pad assembly or components thereof need to be removed, for repair and/or replacement, the assembly procedure is reversed and the outward deflection of the tabs 52 will enable selective removal of the dispenser pad 18 and reservoir pad 20.

The lid 14 is a one piece plastic molding, preferably a polypropylene copolymer, and comprises a generally rectangular top wall 60 peripherally surrounded by a downwardly skirt 62 having an inner surface configured to sealingly engage the outer surface of the top leg 34 of the outer rim 30 thereby sealing the ink reservoir to limit loss of contents.

Figure 2:
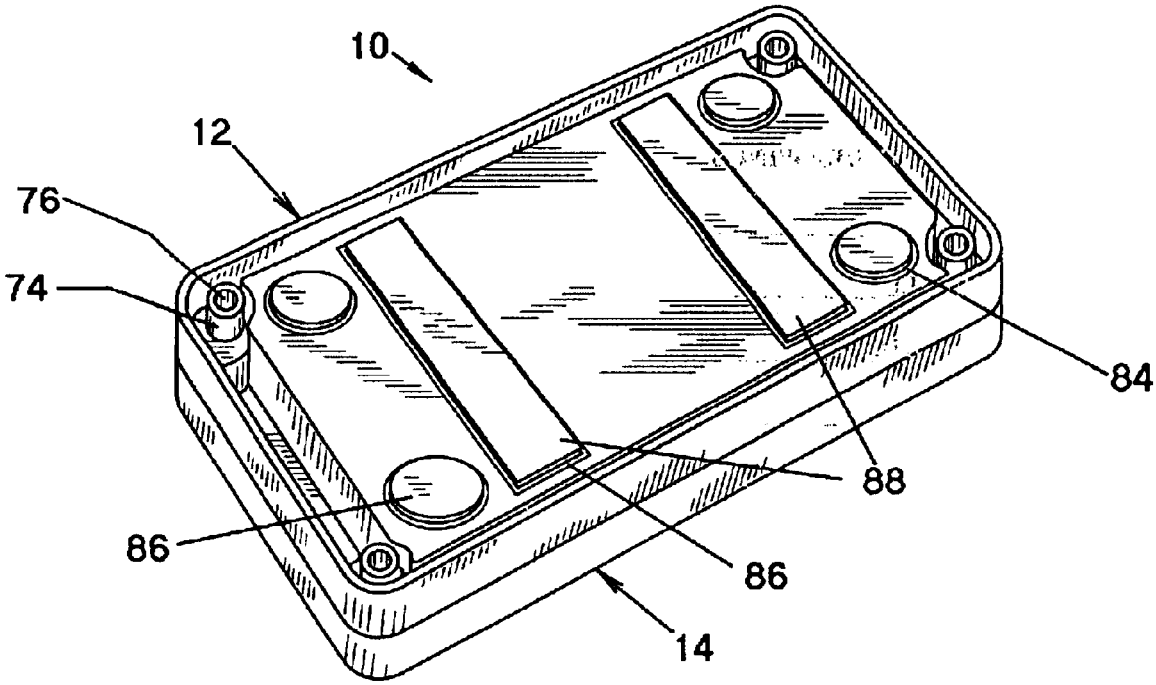
FIG. 2 is a bottom perspective view of the dispenser of FIG. 1.
Figure 3:
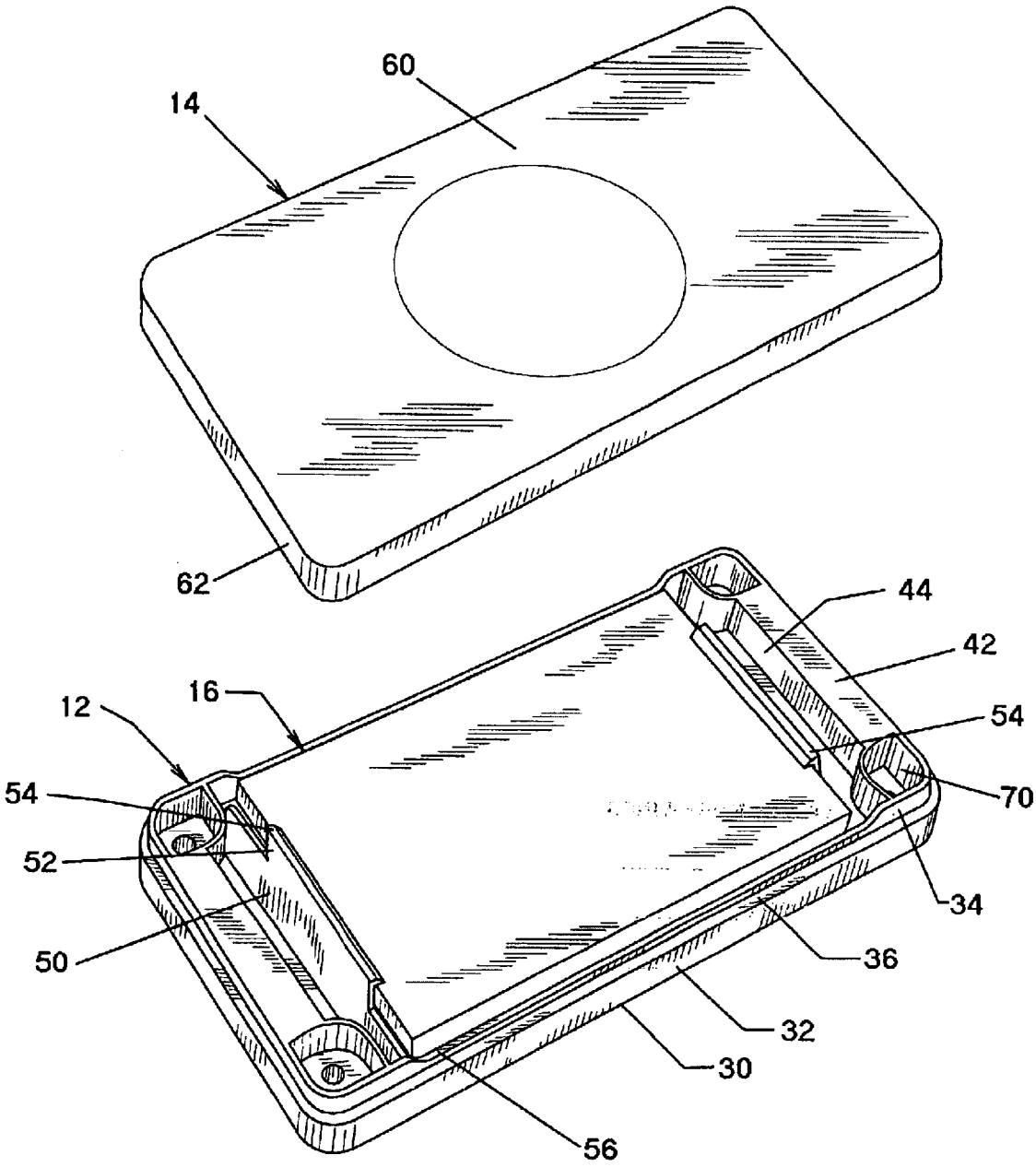
FIG. 3 is an exploded top perspective view of the dispenser of FIG. 1 separately showing the base and lid.

Referring to FIGS. 2 through 4, the inner corners of the outer rim 16 at the shoulders 42 are provided with sockets 70. The base of each socket merges with a downwardly extending sleeve 74. The sleeves 74 include vertical holes 76 that receive threaded fasteners 78 for the mechanical attachment of the base to the top surface of a mounting substrate 80 (FIGS. 6A and 6B). The lower surface of the base plate 44 is provided with raised circular rings 84 adjacent the corners thereof that receive adhesive backed circular pads 86 having high friction lower surfaces for providing non-slip usage of flat surfaces. Inwardly of the rings 84 a pair of laterally spaced raised rectangular rims 87 are formed in the lower surface of the base plate 40 for receiving adhesive backed magnetic strips 88 for permitting magnetic attachment of the dispenser, for use or storage, on ferromagnetic substrates.

In preferred format, the case 10 is about, 6 inches long, 3 inches wide and 1 inch thick, presenting an envelope permitting the case to be transported from site to site, conveniently, in an available pocket or case. For transient site work, the friction and magnetic interfaces permit deployment on a variety of substrates. For stationary use, the mechanical fastening mounting may be employed. Accordingly, rather than relying on a plurality of cases for ordinary use, the present invention provides a single case design useable for all commonly encountered situations within an organization.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. An ink dispenser comprising: a base member and a lid member, said base member having a base surrounded by an upwardly extending peripheral rim defining therewith and upwardly opening cavity; a porous imprint inking dispensing member in said cavity having a lower surface engaging said base and an upper surface for transferring ink to the fingers of a test subject; a pair of flexible tab members on said base member adjacent opposed ends of said rim, said tab members having inwardly projecting surfaces overlying and limitedly engaging discrete portions of said upper surface of said dispensing member for releasably securing said dispensing member in said cavity.

2. An ink dispenser comprising: an imprint ink dispensing assembly including a porous ceramic plate overlying and in interfacial contact with a porous foam pad, said plate and said pad having a generally rectangular cross section having an assembly width, an assembly length, and an uncompressed free height, said plate and said pad retaining a supply of imprint ink transferable by capillary action to a top surface of said plate; a one piece molded case member having a base surrounded by an upwardly extending rim and having an upwardly opening cavity for receiving said dispensing assembly on said base; deflectable tab members on said case laterally spaced at said assembly length adjacent the ends of said plate members; inwardly extending projections on said tab members spaced from said base less than said uncompressed free height and engaging the side edges of the top surface of said ceramic plate in assembled condition whereat said pad member is compressed and effects continuous surface contact with the plate member; and a lid member having a top overlying said cavity and a depending peripheral skirt engaging said rim and sealing the cavity in a closed position.

3. The ink dispenser as recited in claim 2 wherein said tab members are carried on transverse dividing walls in said cavity and have a width less than said assembly width of said dispenser assembly.

4. The ink dispenser as recited in claim 3 wherein said projecting members have a generally triangular cross section including an inwardly and downwardly inclined surface engagable with said plate and deflectable outwardly for moving said dispenser assembly to the assembled condition.

5. The ink dispenser as recited in claim 2 wherein said rim includes apertured sockets for receiving threaded fasteners to permit mechanical attachment of the case to a mounting surface.

6. The ink dispenser as recited in claim 5 including slip resistant pads carried on the lower surface of said base for preventing movement of said case during imprinting.

7. The ink dispenser as recited in claim 6 including magnetic strips carried on the lower surface of said base for permitting mounting of said case on a ferromagnetic surface.

8. An ink dispenser comprising: a lid having a generally rectangular planar top wall surrounded by a downwardly depending skirt; a base member surrounded by an upwardly extending peripheral rim engagable in a closed position with said skirt of said lid and establishing an upwardly opening generally rectangular cavity; laterally spaced flanges at the sides of said rim; apertured sockets formed in said flanges for receiving threaded fasteners to attach said base member to a mounting surface; an imprint ink dispenser assembly comprising an upper rectangular ceramic imprint plate and a lower rectangular compressible foam pad carrying a supply of imprint ink transferable by capillary action to a top surface of said imprint plate for permitting transfer to the fingers of a user; a pair of deflectable tabs on said base member adjacent said flanges and spaced above said base sufficiently to engage discrete lateral end portions of said plate and retain said dispenser assembly in said dispenser assembly upon compression of said pad member; circular rims formed on said bottom wall of said cavity adjacent the corners thereof for receiving slip resistance pad members therewithin; and a pair of laterally spaced rectangular ridges formed on said bottom wall of said cavity for receiving magnetic strips for magnetically attaching said base to a ferrous substrate.

* * * * *